United States Patent [19]

Rorabaugh

[11] Patent Number: 4,597,553

[45] Date of Patent: Jul. 1, 1986

[54] TRACK-MOUNTED SUPPORT

[76] Inventor: Barre L. Rorabaugh, 8839 Production Ave., San Diego, Calif. 92121

[21] Appl. No.: 695,090

[22] Filed: Jan. 25, 1985

[51] Int. Cl.[4] ..... F16M 11/38

[52] U.S. Cl. ..... 248/440; 108/117; 248/188.2; 248/188.6; 272/144

[58] Field of Search ..... 248/440, 166, 439, 440.1, 248/188.6, 188.91, 188.1, 188.2; 182/155; 272/144; 108/130, 131, 132, 129, 117, 120

[56] References Cited

U.S. PATENT DOCUMENTS

| | | | |
|---|---|---|---|
| 82,360 | 9/1868 | Smith | 108/132 |
| 1,806,091 | 5/1931 | Simpson | 108/132 |
| 2,676,680 | 4/1954 | Kindorf | 248/228 |
| 3,136,269 | 6/1964 | McDonald | 272/144 X |
| 3,610,425 | 10/1971 | Madey | 248/220.3 |
| 4,143,602 | 3/1979 | Brunn | 108/117 |

FOREIGN PATENT DOCUMENTS

| | | | |
|---|---|---|---|
| 1076920 | 3/1960 | Fed. Rep. of Germany | 108/132 |
| 7710976 | 10/1976 | Netherlands | 108/117 |
| 197561 | 11/1906 | Switzerland | 108/132 |

*Primary Examiner*—J. Franklin Foss
*Assistant Examiner*—David L. Talbott
*Attorney, Agent, or Firm*—Robert A. Hirschfeld; James F. Duffy

[57] ABSTRACT

A load is supported by three subjacent parallel tracks. A u-shaped leg structure coupled to pivots fixed to the outer tracks defines a locus of intersection between swinging arc of the u-shaped leg structure and the ground. A third leg pivots from a slider selectably disposed along the central third track, and also pivots at its bottom end to the u-shaped leg structure, defining a range of loci at the ground which position the tracks upwardly sloping, downwardly sloping or horizontal with respect to a fulcrum. The support is mounted to the tracks by captive sliders, some fixed, others slideable between captive stops.

10 Claims, 8 Drawing Figures

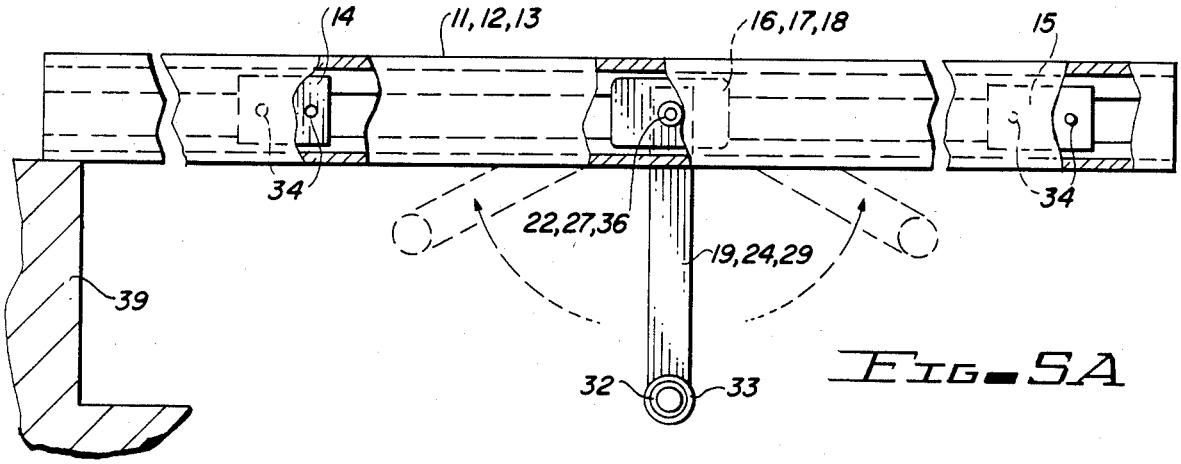
FIG. 5A
FIG. 5B
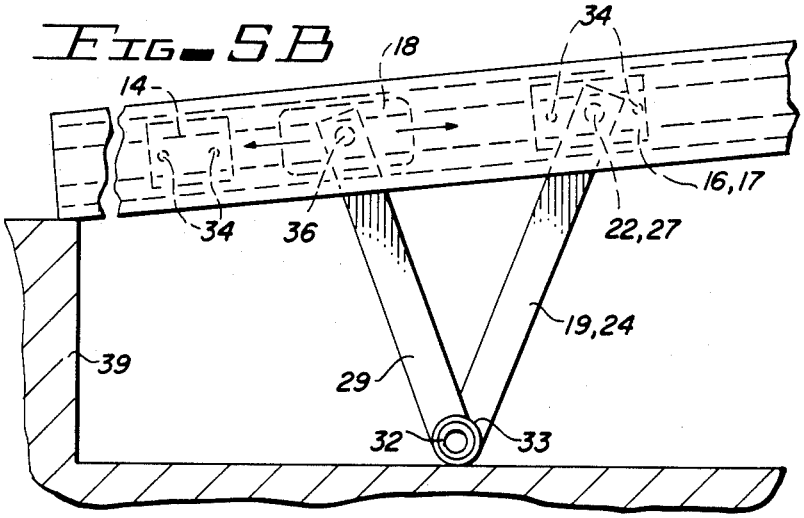
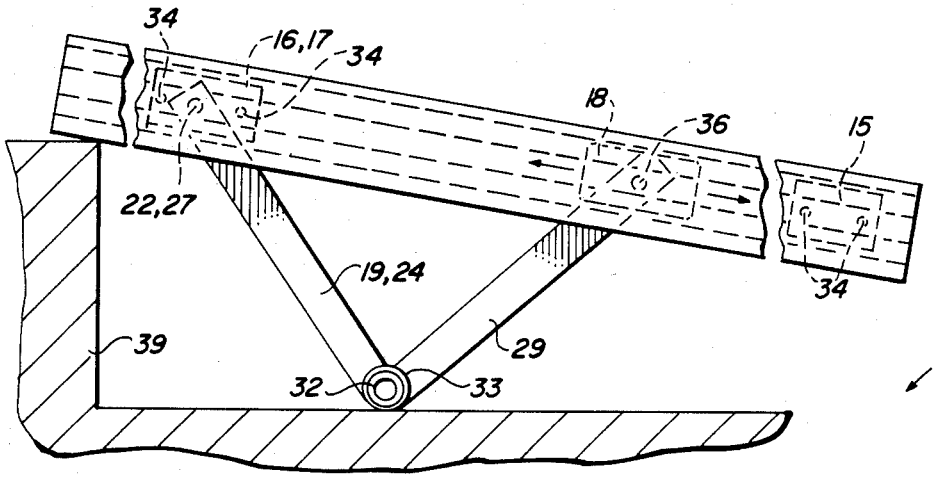
FIG. 5C
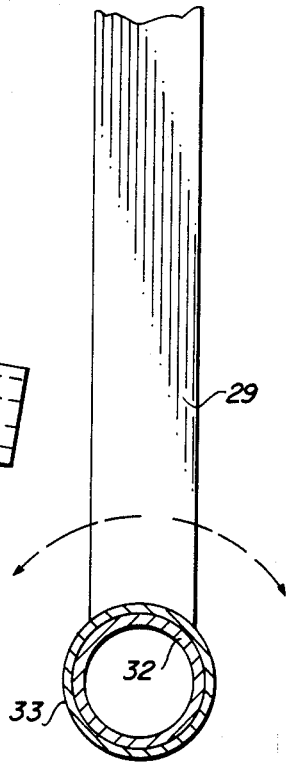
FIG. 6

TRACK-MOUNTED SUPPORT

RELATED APPLICATION

A highly versatile exercise system based upon the selectable attachment of various exercise devices to a plurality of extruded parallel tracks is disclosed in the inventor's application No. 653,551, filed Sept. 9, 1984, entitled MULTIPLE DEVICE EXERCISE SYSTEM. Said system is intended, in one embodiment, to be cantilevered from a hinge in a wall-mounted cabinet. When the cantilever descends to horizontal or nearly horizontal position, support is required for part of the body weight of a person using the exercise system. The present invention is an improvement on said MULTIPLE DEVICE EXERCISE SYSTEM wherein the tracks themselves are used to facilitate positionally adjustable support of the free end of the cantilever of said SYSTEM.

DESCRIPTION

1. Technical Field

The invention relates to the field of supports for substantially horizontal tables and the like, and more particularly to supports slidingly disposed upon a plurality of tracks.

2. Background Art

In his application No. 653,551, MULTIPLE DEVICE EXERCISE SYSTEM, the inventor shows that it is desirable to support the cantilevered end of his exercise system at various angles from slightly inclined, to horizontal, to slightly downward-sloping, as is needed to accommodate various modes of exercise. Although said SYSTEM disclosed a unitary system of parallel extruded tracks from which all manner of modular exercise devices could be operated, he only pointed out the need for variation in end support, without solving the problem. Among the requirements of such a support are overall light weight, in keeping with the fold-up character of the system, reliability, ease of deployment and adjustment. A number of prior-art solutions, such as those used for card tables, folding conference tables and the like, were examined by the inventor and rejected as unsuitable, before the inventor perceived the synergistic approach of using the tracks or rails themselves as elements in the support.

Accordingly, it is an object of the present invention to provide a track-mounted support which is stably positionable at a plurality of support heights.

A further object of the present invention is to provide a track-mounted support whose adjustment and disposition means is directly coupled to a track system.

Another object of the present invention is to provide adjustability of location of the track-mounted support along a track system.

Still another object of the present invention is to provide a track-mounted support whose pendent coupling to a track system does not interfere with exercise devices coupled above and below the same track system.

DISCLOSURE OF THE INVENTION

An approximately horizontal load is supported by three subjacent parallel tracks. Fixedly coupled to each of the outer tracks are pivots, from which depend and pivot legs , bridged fixedly at the free-swinging bottom thereof. A third leg is pivotingly coupled to a captive slider within the central, third track at its top, and pivotingly coupled to the bridging member joining the bottom of the outer two legs, at the third leg's bottom. The resulting structure is adjusted as to overall height by sliding the captive slider from which the third leg is pendent, along the third, central track in spaced relationship to the fixed pivot loci of the first and second legs. The entire system is mounted, either slidingly or fixedly, by plates captive within or to the three tracks. The base rod, or bridging member, forms a pivot around which is fitted a ferrule at the lower end of the third, central leg. In one embodiment, only one of the two outer pivots need be fixed with respect to the respective track, as the remainder of the outer-track members are rigidly coupled. Setscrews permit selective relocation of fixed elements within or upon the track system.

BRIEF DESCRIPTION OF THE DRAWINGS

FIGS. 5A, 5B and 5C respectively show side views of the invention in approximately horizontal, upward sloping and downward sloping disposition of the cantilever.

FIG. 6, i s a sectional view of the central leg along line 6 of FIG. 2.

BEST MODE FOR CARRYING OUT THE INVENTION

Figure 1:
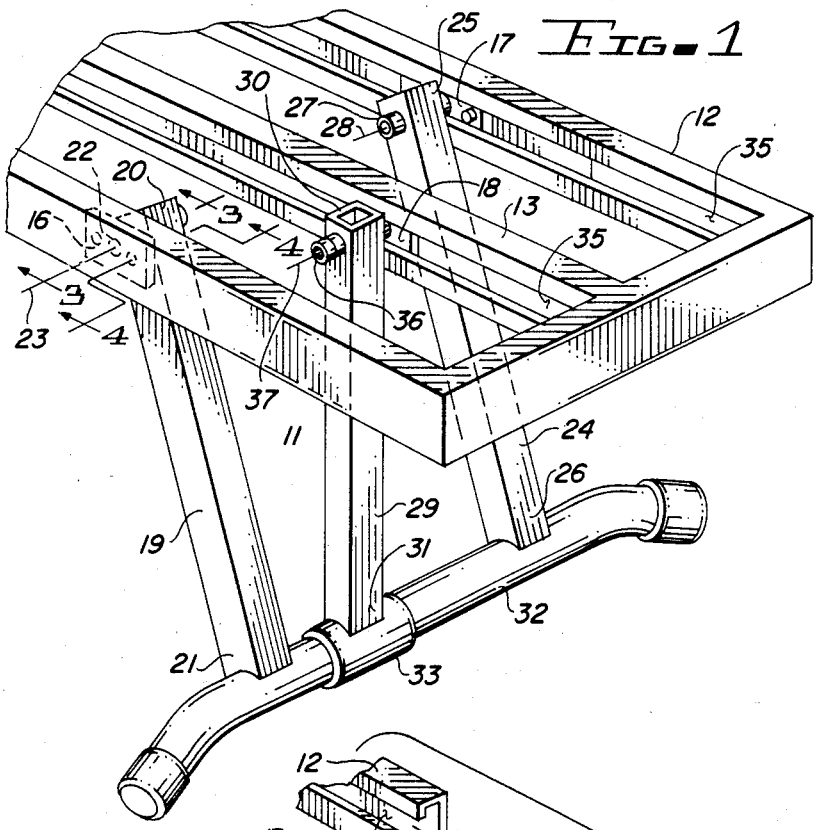
FIG. 1 is a perspective view of the invention.

For the purposes of promoting an understanding of the principles of the invention, reference will now be made to the embodiments illustrated in the drawings. Specific language will be used to describe the same. It will, nevertheless, be understood that no limitation of the scope of the invention is thereby intended, such alterations and further modifications in the illustrated device, and such further applications of the principles of the invention as illustrated therein being contemplated as would normally occur to one skilled in the art to which the invention relates.

The track-mounted support, generally referred to as number 10, comprises first track 11, second track 12 parallel track 11, and third track 13, which is disposed between outer tracks 11 and 12. Although referred to as sliders 16,17, said sliders are in use fixed respectively within first track 11 and second track 12 by setscrews 34 (shown in FIGS. 2,4, 5A,B,C), with respective first and second pivots, 22,27 coaxial to first and second pivot axes 23, 28. First leg 19 is pivoted at its upper end 20 about pivot 22. Second leg 24 is pivoted at its uppper end 25 about pivot 27. Lower ends 21 and 26 respectively of legs 9,24 are rigidly fixed to base rod 32, and are thus always parallel each other. Third slider 18 is free to captively traverse third track 13 between stops (not shown in FIG. 1). The upper end 30 of third leg 29 is pivoted by third pivot 36 from third slider 18 about third pivot axis 37. First pivot axis 23, because of the rigid coupling of the outer legs, is always coaxial to second pivot axis 28.

Figure 2:
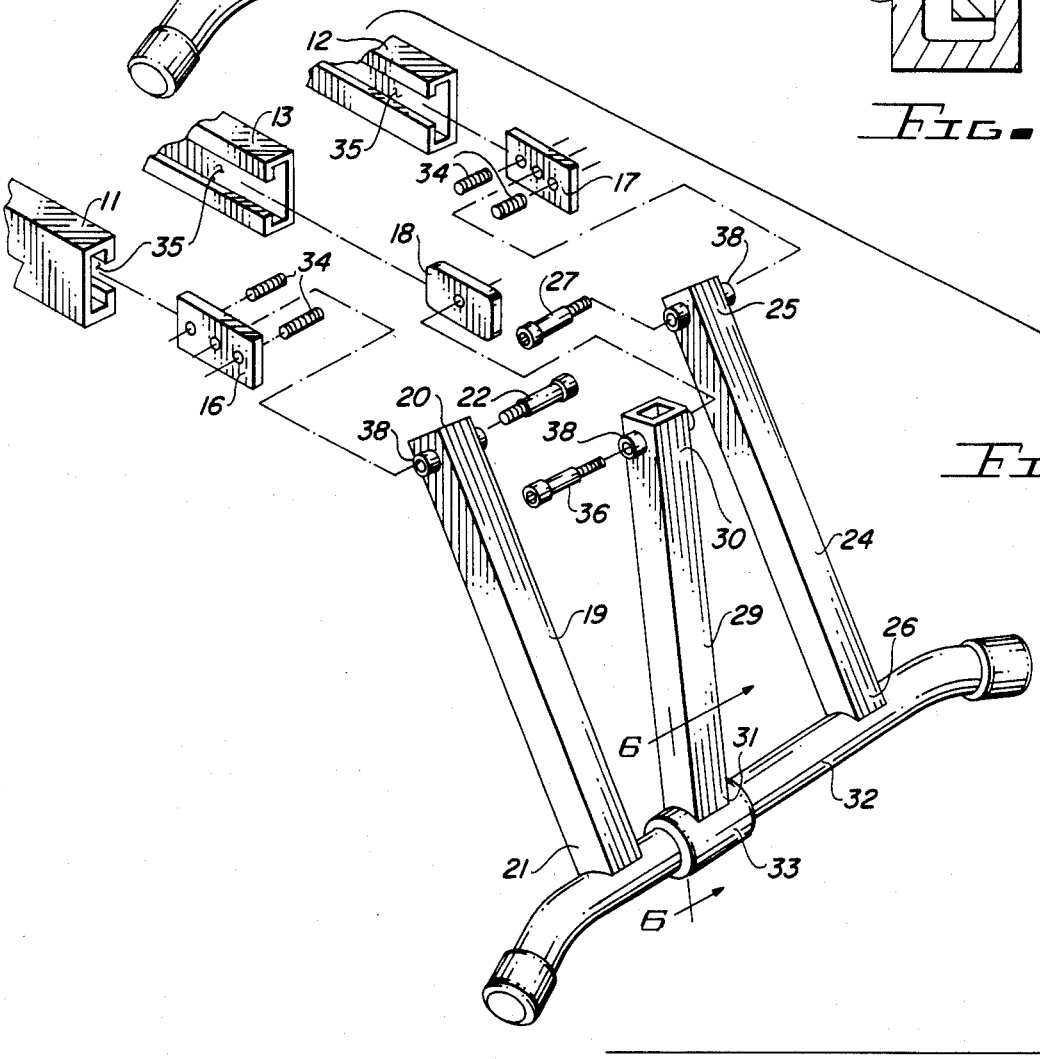
FIG. 2 is an exploded view of FIG. 1 showing how the sliders and pivots are assembled to the legs.

At lower end 31 of third leg 29,fourth pivot 33 is orthogonally coupled, comprising a bushing or ferrule 33 through which base rod 32 extends as more clearly shown in FIG. 6 along line 6—6 of FIG.2.

FIG. 2 shows in exploded view how the sliders and pivots are assembled. Slider 16 is inserted from an end of track 11 into longitudinal cavity 35, where it is fixed in position by setscrews 34. Similarly, slider 17 is inserted into longitudinal cavity 35 of track 12 and fixed in position by setscrews 34. Third slider 18 freely slides within longitudinal cavity 35 of third track 13. Threaded pivot screws 22,27,36 are respectively threadly coupled to sliders 16,17,18, and rotate within pivot bushings 38 coupled to the respective legs.

Figure 3:
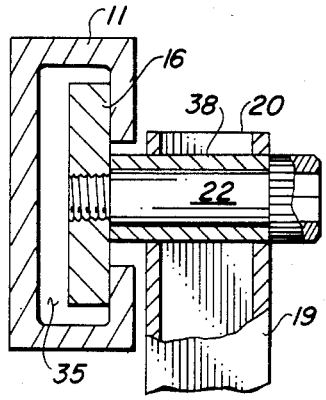
FIG. 3 is a section along line 3—3 of FIG. 1 showing the track, slider, pivot and leg in cross-section.

FIG. 3, along line 3—3 of FIG. 1, more clearly shows the threaded coupling of pivot 22 to slider 16. For clarity, setscrews are omitted on FIG. 3; however, absent said setscrews, FIG. 3 also illustrates the structure of third slider 18, which either lacks setscrews, or has setscrews in retracted state.

Figure 4:
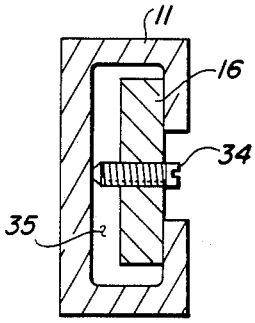
FIG. 4 is a section along line 4—4 of FIG. 1, showing a setscrew fixing a slider within a track portion.

FIG. 4, along line 4—4 of FIG. 1, shows penetration of setscrew 34 to coact with longitudinal cavity 35 of track 11. Although not separately illustrated, stops 14,15 within third track 13 comprise the same structure as the sliders, with setscrews, but without pivots. Thus it may be seen that an inventory of a single universal slider may provide, depending upon coupling to setscrews and/or pivots, all of the slider structures of the invention.

In FIG. 5A, third slider 18 is lined up with first and second sliders 16,17, with their respective pivot axes 23,28,37 coaxial. In the condition of FIG. 5A, the total leg structure may be folded up, or may provide approximately horizontal support for the cantilever comprising the tracks upon fulcrum 39.

In FIG. 5B, third slider 18 is disposed toward first stop 14 in the direction toward fulcrum 39. Thus, the geometry of the legs creates an upward slope for tracks 11,12,13. Stop 14 is captive in third track 13.

In FIG. 5C, third slider 18 is disposed toward second stop 15 captive in third track 13, with the resulting geometry creating a downward slope for tracks 11,12,13.

As defined herein, stops 14,15 comprise interference plates. Longitudinal cavity 35 is preferably C-shaped; however, the invention contemplates any means for retaining and sliding sliders 16,17,18 with respect to tracks, including in the alternative, sliders which circumscribe rather than slide within track means.

What has been disclosed is a track-mounted support which gains its versatility from disposition in relation to three parallel tracks. An outer u-shaped leg structure defines an arc of bottom base rod locus, said locus intersecting the ground. A third leg defines a fixed distance between the base rod locus and a moveable third slider selectedly disposed along the third track intermediate the outer tracks, to which the u-shaped leg structure is pivotingly affixed. The resulting range of base rod loci permits variation of angular slope of the tracks with respect to a fulcrum varying from downward through horizontal to upward sloping.

As defined herein, setscrews 34 comprise anti-sliding fixation means.

Those skilled in the art will conceive of other embodiments of the invention which may be drawn from the disclosure herein. To the extent that such other embodiments are so drawn, it is intended that they shall fall within the ambit of protection provided by the claims herein.

Having described my invention in the foregoing description and drawings in such a clear and concise manner that those skilled in the art may readily understand and practice the invention, that which I claim is:

1. A track-mounted support for adjustably supporting a load adjacent a selected track location, said track-mounted support comprising:

first track means subjacent said load;

second track means subjacent said load, said second track means parallel said first track means;

third track means subjacent said load intermediate said first track means and said second track means, said third track means parallel said first track means and said second track means;

first stop means adjustably coupled to said third track means, for limiting sliding excursion along said third track means;

second stop means adjustably coupled to said third track means in spaced relationship with said first stop means, for limiting sliding excursion along said third track means;

first slider means slidingly captive to said first track means, said first slider means having anti-sliding fixation means;

second slider means slidingly captive to said second track means;

third slider means slidingly captive to said third track means intermediate said first and second stop means;

first leg means having an upper end and a lower end, said upper end of said first leg means pivotingly coupled to said first slider means by first pivot means along a first pivot axis;

second leg means having an upper end and a lower end, said upper end of said second leg means pivotingly coupled to said second slider means by second pivot means along a second pivot axis, said second leg means parallel said first leg means, said second pivot axis collinear said first pivot axis intermediate said first and second stop means.

third leg means having an upper end and a lower end, said upper end of said third leg means pivotingly coupled to said third slider means by third pivot means along a third pivot axis parallel said first pivot axis and said second pivot axis; and base rod means, said base rod rigidly orthogonally coupled to said lower end of said first leg means, said base rod rigidly orthogonally coupled to said lower end of said second leg means, said base rod pivotingly orthogonally coupled by fourth pivot means to said lower end of said third leg means along a fourth pivot axis parallel said first, second and third pivot axes.

2. The track-mounted support of claim 1 wherein said second slider means has anti-sliding fixation means.

3. The track-mounted support of claim 1 wherein said track means comprises an elongated extrusion having a C-shaped longitudal cavity , said slider means comprises sliding plate means captive within said C-shaped longitudinal cavity.

4. The track-mounted support of claim 3 wherein said stop means comprises interference plate means within said C-shaped longitudinal cavity, said interference plate means having anti-sliding fixation means.

5. The track-mounted support of claim 4 wherein said anti-sliding fixation means of said interference plate means comprises setscrew means threadedly disposed through said interference plate means for engaging said third track means.

6. The track-mounted support of claim 1 wherein said anti-sliding fixation means of said first slider means comprises setscrew means threadedly disposed through said first slider means for engaging said first track means.

7. The track-mounted support of claim 2 wherein said anti-sliding fixation means of said second slider means comprises setscrew means threadedly disposed through said second slider means for engaging said second track means.

8. The track-mounted support of claim 1 wherein said first pivot means is threadedly coupled to said first slider means, said second pivot means is threadedly coupled to said second slider means, and said third pivot means is threadedly coupled to said third slider means.

9. The track-mounted support of claim 1 wherein said fourth pivot means comprises ferrule means joined to said lower end of said third leg means, said base rod means having cylindrical outer cross-section rotatable within said ferrule means, said base rod means concentric with said ferrule means.

10. The track-mounted support of claim 1 wherein said track means are affixed in spatial relationship subjacently to said load.

* * * * *